United States Patent [19]

Lorenzen et al.

[11] Patent Number: 4,616,663

[45] Date of Patent: Oct. 14, 1986

[54] METHOD AND APPARATUS FOR FORMING A HOMOGENEOUS MASS OF COMMINUTED SMOKABLE MATERIAL

[75] Inventors: Heinz-Christen Lorenzen, Wentorf; Uwe Heitmann, Hamburg; Wolfgang Steiniger, Börnsen, all of Fed. Rep. of Germany

[73] Assignee: Hauni-Werke Körber & Co. KG., Hamburg, Fed. Rep. of Germany

[21] Appl. No.: 666,189

[22] Filed: Oct. 29, 1984

[30] Foreign Application Priority Data

Nov. 2, 1983 [DE] Fed. Rep. of Germany ..... 3339588

[51] Int. Cl.[4] ..... A24C 5/39

[52] U.S. Cl. ..... 131/109.3; 131/109.1

[58] Field of Search ..... 131/108, 109.1, 109.2, 131/109.3

[56] References Cited

U.S. PATENT DOCUMENTS 3,138,163 6/1964 Ffoulkes ..... 131/109.3

4,185,644 1/1980 Heitmann et al. ..... 131/109.1

*Primary Examiner*—V. Millin

*Attorney, Agent, or Firm*—Peter K. Kontler

[57] ABSTRACT

A stream of agglomerated short, medium long and long tobacco shreds as well as clumps or lumps of shreds and elongated fragments of tobacco ribs is fed onto a vibrating sieve which permits the short and medium long shreds to descend onto a first vibrating conveyor and causes the long shreds, clumps and fragments of ribs to advance onto a second vibrating conveyor whose upper surface has longitudinally extending grooves for the fragments. The long shreds and clumps are removed from the conveyor by a rotating carded drum which breaks up the clumps and delivers the long shreds and the shreds of the broken up clumps into a duct. The latter also receives short and medium long shreds from the first conveyor which is mounted below the second conveyor. The latter has openings for short and medium long shreds which might have been entrained by the long shreds, clumps and fragments of ribs. A metering device regulates the rate of admission of long shreds and shreds of the broken-up clumps into the duct. The rate of admission of agglomerated shreds and sieve receives predetermined quantities of unsifted material per unit of time.

25 Claims, 4 Drawing Figures

METHOD AND APPARATUS FOR FORMING A HOMOGENEOUS MASS OF COMMINUTED SMOKABLE MATERIAL

BACKGROUND OF THE INVENTION

The present invention relates to a method and apparatus for forming a homogeneous mass of comminuted smokable material, especially for forming a homogeneous mass of tobacco shreds. More particularly, the invention relates to improvements in a method and apparatus for forming a homogeneous mass which consists of tobacco shreds or the like and can be converted into the filler of a continuous rod, such as cigarette rod.

U.S. Pat. No. 3,138,163 discloses a cigarette rod making machine wherein a sifting device separates short and medium long shreds from long shreds and fragments of tobacco ribs. The separated short and medium long shreds are caused to form a first layer, and the separated long shreds and fragments of tobacco ribs are showered onto the first layer to form thereon a second layer, i.e., the two layers jointly contain all of the ingredients of the agglomeration of shreds and fragments of ribs which were delivered to the sifting device. The material of the two layers is then introduced into a suction air stream which entrains the short, medium long and long shreds (i.e., the particles which are obtained in response to comminution of tobacco leaf laminae) but is incapable of entraining the relatively heavy and bulky fragments of tobacco ribs. In this manner, the fragments of ribs are segregated from the shreds and the shreds are used to form a tobacco stream which is ready to be draped into cigarette paper or the like.

A drawback of the patented apparatus is that it cannot ensure reliable segregation of all fragments of ribs which could interfere with the formation of a satisfactory tobacco stream and also that the apparatus cannot effect predictable disintegration of clumps or lumps of tobacco shreds which are normally present in the material that is being fed to the sifting device.

OBJECTS AND SUMMARY OF THE INVENTION

An object of the invention is to provide a novel and improved method of forming a homogoneous mass of particles of smokable material which ensures more reliable segregation of rigid constituents (such as fragments of tobacco ribs) than heretofore known methods.

Another object of the invention is to provide a method which can be used to form a homogeneous mass of satisfactory particles of smokable material and which can be used to simultaneously break up at least some if not all clumps or lumps of coherent shreds or like useful particles.

A further object of the invention is to provide a method of the above outlined character which need not involve the transport of any particles by streams of air or another gaseous medium that could appreciably alter the moisture content and/or other characteristics of the particles.

An additional object of the invention is to provide a novel and improved apparatus which can be used for the practice of the above outlined method and can reliably segregate all or practically all rigid constituents (such as fragments of tobacco ribs) from the remaining (more acceptable) constituents in a small area, without employing any pneumatic conveyor means, and without subjecting the satisfactory particles (such as short, medium long and long tobacco shreds) to any or any appreciable comminuting action.

Still another object of the invention is to provide an apparatus which, in addition to forming a homogeneous mass of satisfactory particles of smokable material, can break up all or nearly all clumps or lumps of coherent satisfactory particles so that such particles can be mixed with other satisfactory particles and can be used in the making of a highquality tobacco stream.

An additional object of the invention is to provide the apparatus with novel and improved means for segregating rigid constituents (such as fragments of tobacco ribs) from satisfactory particles of tobacco leaf laminae and/or other smokable material.

A further object of the invention is to provide the apparatus with novel and improved means for breaking up clumps of tobacco shreds or the like.

One feature of the invention resides in the provision of a method of forming a homogeneous mass (e.g., a column) from an agglomeration of tobacco and/or other smokable material including short, medium long and long shreds as well as clumps of shreds and elongated relatively rigid constituents, such as portions or fragments of tobacco ribs. The method comprises the steps of sifting the agglomeration to thereby separate short and medium long shreds from long shreds, clumps and rigid constituents, imparting to the rigid constituents a predetermined orientation to facilitate their segregation from shreds, segregating the long shreds and the clumps from the thus oriented rigid constituents, and merging the thus segregated long shreds and the shreds of the clumps with the short and medium long shreds. The sifting step preferably includes vibrating the agglomeration, and the orientation changing step preferably includes vibrating the rigid constituents. The segregating step can include transporting the long shreds, the clumps and the rigid constituents along a first path and diverting the long shreds and the clumps from the first path into a different second path.

In accordance with a presently preferred embodiment of the method, the orientation imparting step includes transferring the rigid constituents onto the undulate surface of a vibratory conveyor so that the rigid constituents find their way into the valleys of the undulate surface. Such surface of the vibratory conveyor has elongated parallel grooves which constitute the aforementioned valleys and each of which can have a substantially triangular cross-sectional outline with the grooves tapering downwardly so that the elongated rigid constituents tend to penetrate into the bottom or deepmost regions and extend longitudinally of such grooves.

The sifting step can precede the orientation imparting step, and the merging step can include admitting metered quantities of long shreds and shreds of the clumps to the short and medium long shreds.

The method preferably further comprises the step of breaking up the clumps not later than in the course of the merging step. For example, at least a portion of the step of breaking up the clumps can take place subsequent to the segregating step but prior to the merging step.

Another feature of the invention resides in the provision of an apparatus for forming a homogeneous mass from an agglomeration of tobacco and/or other smokable material including short, medium long and long shreds as well as clumps of shreds and elongated relatively rigid constituents, such as portions or fragments of tobacco ribs. The improved apparatus comprises a sifting device having a mesh such that it permits the passage of short and medium long shreds by gravity, means for vibrating the sifting device so as to promote the passage of short and medium long shreds therethrough, means for feeding the agglomeration of shreds and rigid constituents so that the sifting device separates the short and medium long shreds from the long shreds, clumps and rigid constituents, first conveyor means for transporting the separated short and medium long shreds along a first path, second conveyor means for transporting the separated long shreds, clumps and rigid constituents along a second path, means for imparting to the rigid constituents a predetermined orientation, and means for segregating the long shreds and the clumps of shreds from the oriented rigid constituents. The apparatus further comprises third conveyor means for transporting the segregated long shreds and the shreds of the clumps into the first path so that such shreds merge into the previously separated short and medium long shreds. The third conveyor means can comprise means for admitting metered quantities of long shreds and of the shreds of the clumps into the first path.

The second conveyor means is preferably arranged to advance the long shreds, the clumps and the rigid constituents in a predetermined direction, and the orientation imparting means preferably includes a vibratory conveyor having elongated recesses which extend in the predetermined direction and serve to receive the elongated rigid constituents so that such constituents extend longitudinally of the respective recesses. For example, the vibratory conveyor can have an undulate upper surface provided with alternating hills and valleys. The valleys constitute the aforementioned recesses and each thereof preferably has a substantially triangular cross-sectional outline. The vibratory conveyor and the entire orientation imparting means preferably form part of or constitute the second conveyor means.

The sifting device is preferably designed to advance the long shreds, the clumps and the rigid constituents in the predetermined direction, and the second conveyor means is preferably immediately adjacent to the sifting device so that it can receive such material directly from the sifting device.

The orientation imparting means, such as the aforediscussed vibratory conveyor, is preferably formed with openings which allow for gravitational descent of any short and/or medium long shreds that might have been entrained into the second path so that such shreds are not segregated together with the rigid constituents but can be admitted into the first path.

The third conveyor means preferably comprises or cooperates with means for breaking up at least some of the clumps ahead of the first path, i.e., ahead of the locus of admission of long shreds and shreds of the clumps into the first path.

The apparatus can further comprise a magazine (e.g., an upright duct) for reception of short and medium long shreds from the first conveyor means, and the third conveyor means can be arranged to transport the segregated long shreds and the shreds of the clumps directly into the magazine. Such magazine can be said to define the last portion of the first path.

The vibrating means can include means for vibrating the sifting device jointly with the first conveyor means. The latter can constitute a vibratory conveyor which is disposed at a level below the sifting device.

Still further, the apparatus can comprise means for regulating the feeding means in dependency on variations of the quantity of shreds and rigid constituents on the sifting device so that such quantity remains at least substantially constant, e.g., in such a way that the sifting device receives predetermined quantities of the agglomeration of short, medium long and long shreds, clumps and rigid constituents per unit of time.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
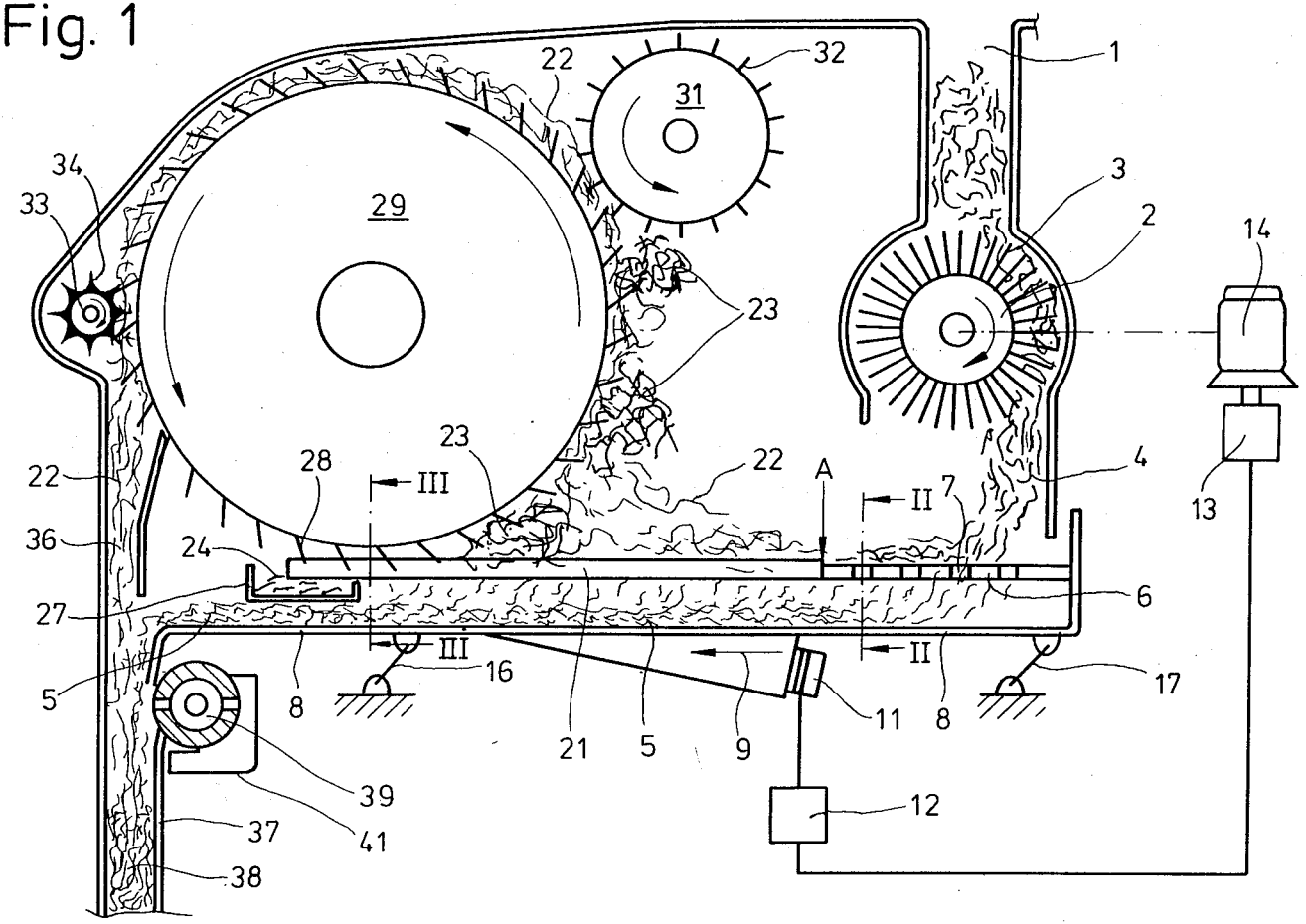
FIG. 1 is a schematic elevational view of an apparatus which embodies the invention.
Figure 2:
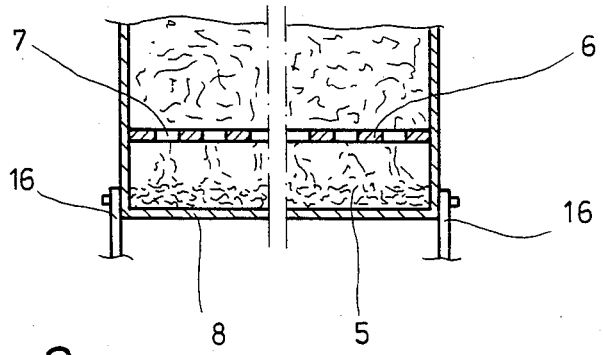
FIG. 2 is an enlarged fragmentary transverse vertical sectional view as seen in the direction of arrows from the line II—II of FIG. 1.

The apparatus which is shown in the drawing comprises a sifting device 6 in the form of a horizontal sieve having relatively large openings or interstices 7 for the passage of short and medium long tobacco shreds 5. The means for feeding an agglomeration 4 of tobacco shreds and elongated rigid fragments 24 of tobacco ribs onto the sieve 6 comprises a wheel-shaped supplying member 2 having radially extending pins 3 serving to entrain the comminuted smokable material 4 from an upright duct 1 and to deliver it onto the sieve 6. The material 4 contains the aforementioned short and medium long shreds 5, long shreds 22, clumps or lumps 23 of interlaced shreds (these may include short, medium long and long shreds) and the aforementioned fragments 24 of ribs in random distribution. The duct 1 receives comminuted smokable material 4 from a main source (e.g., a large hopper), preferably by way of an automatically operated pneumatic conveyor system, whenever the supply of material therein decreases below a preselected level. The means for monitoring the level of the top surface of the supply of smokable material 4 in the duct 1 is not shown in the drawing.

The purpose of the improved apparatus is to reliably segregate the fragments 24 from the short, medium long and long shreds and preferably also to break up the clumps 23 so that their shreds can be mixed with the other shreds to form a homogeneous mass 38 in a magazine here shown as an upright duct 37. The mass 38 is then converted into a continuous tobacco stream which is trimmed to form a rod-like filler prior to being draped into a web of cigarette paper or the like. The fragments 24 of ribs could puncture the wrapping material and could also interfere with predictable conversion of the mass 38 into a homogeneous tobacco stream.

The length of the short and medium long shreds 5 need not appreciably exceed the diameter of a cigarette rod. Thus, if the diameter of the cigarette rod is or approximates 8 mm, the dimensions of the openings 7 (i.e., the mesh of the sieve 6) can be selected in such a way that these openings permit the passage of shreds whose length does not appreciably exceed 10 mm. The shreds 5 which pass through the openings 7 descend by gravity onto a conveyor 8 which constitutes a means for transporting the shreds 5 along a preferably (but not necessarily) horizontal first path. The means for vibrating the sieve 6 jointly with the conveyor 8 includes a vibrator 11. The nature of vibratory movements which are imparted to the conveyor 8 and sieve 6 is such that the conveyor 8 transports the short and medium long shreds 5 in the direction of arrow 9 and that the sieve 6 advances the long shreds 22, the clumps 23 and the fragments 24 of ribs in the same direction.

It is clear that the illustrated vibratory conveyor 8 can be replaced with an endless belt conveyor which may but need not be vibrated and whose upper reach advances the shreds 5 in the direction of arrow 9. Other types of conveyors can be used with equal or similar advantage.

The energy requirements of the vibrator 11 are monitored by a suitable sensor 12 which transmits signals to a regulating device 13 which controls the speed of the motor 14 for the supplying member 2. The sensor 12 enables the motor 14 to effect the feed of comminuted smokable material (agglomeration) 4 at a rate such that the sieve 6 receives predetermined unit quantities of such material per unit of time. Thus, when the energy requirements of the vibrator 11 are high because the sieve 6 carries an excessive quantity of smokable material 4, the sensor 12 transmits a signal which causes the regulating device 13 to reduce the speed of the motor 14 and supplying member 2 so that the rate of delivery of smokable material 4 onto the sieve 6 is reduced, and vice versa. The reference characters 16 and 17 denote customary leaf springs on which the conveyor 8 and sieve 6 are mounted in the frame of the improved apparatus. The latter is installed in a cigarette rod making machine, such as the machine known as PROTOS which is manufactured and distributed by the assignee of the present application.

Figure 3:
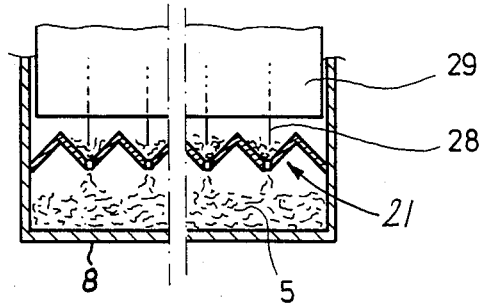
FIG. 3 is a similar enlarged fragmentary transverse vertical sectional view as seen in the direction of arrows from the line III—III of FIG. 1.
Figure 4:
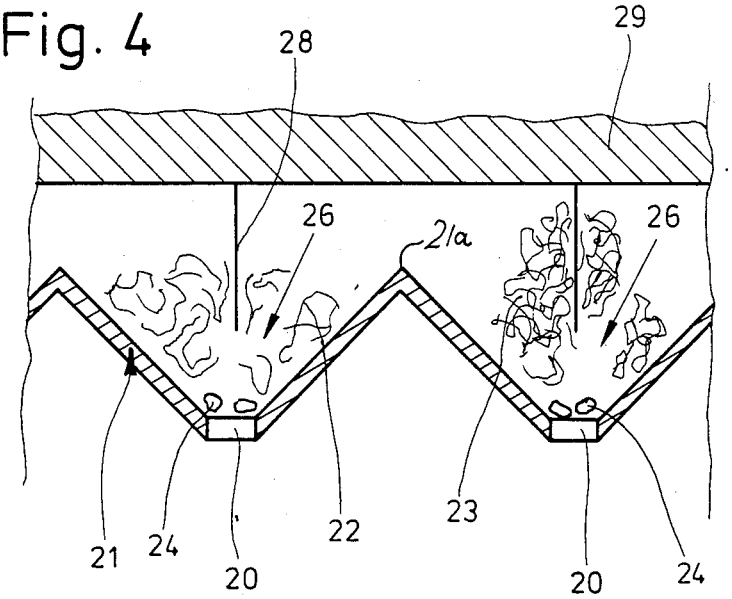
FIG. 4 is an enlarged view of a detail in the structure of FIG. 3.

The arrow A indicates in FIG. 1 the location where the sieve 6 delivers long shreds 22, clumps 23 and fragments 24 of ribs onto a second conveyor 21 which is immediately adjacent to the sieve and also receives motion from the vibrator 11. The conveyor 21 is or includes a horizontal or substantially horizontal plate made of sheet metal or the like and having an undulate upper side or surface (note FIGS. 3 and 4). Thus, the sheet metal plate includes alternating hills or ridges 21*a* and valleys or recesses 26 in the form of elongated grooves which are parallel to the direction indicated by the arrow 9. It is presently preferred to provide the plate of the conveyor 21 with grooves 26 having a substantially V-shaped cross-sectional outline (this can be readily seen in FIGS. 3 and 4) and to provide the conveyor 21 with a row of openings 20 in the deepmost portion of each groove 26. This enables the short and medium long shreds 5 which might have been entrained with the clumps 23, long shreds 22 and fragments 24 to descend through the openings 20 and onto the first conveyor 8 therebelow.

The conveyor 21 defines an elongated second path for the shreds 22, clumps 23 and fragments 24. The relatively heavy and rigid fragments 24 undergo automatic orientation in response to vibration of the conveyor 21 so that they descend into the adjacent grooves 26 and each thereof extends in the direction which is indicated by the arrow 9. At least the majority of long shreds 22 and the clumps 23 do not penetrate into the grooves 26 so that they can be more readily segregated from the fragments 24 in the bottom portions of the grooves 26 by the carding 28 of a rotary wheel-shaped third conveyor 29 which forms part of means for transporting the long shreds 22 and the shreds of the clumps 23 into the duct 37.

The orientation imparting conveyor 21 advances the fragments 24 into a collecting receptacle 27 so that such fragments are removed from the second path. The carding 28 segregates the long shreds 22 and the clumps 23 from the oriented fragments 24 at least slightly upstream of the collecting receptacle 27. The carding 28 thereupon transports the shreds 22 and the clumps 23 in a counterclockwise direction, as viewed in FIG. 1, and past a combing roller 31 which is driven to rotate in a counterclockwise direction and whose prongs 32 comb the protruding portions of the clumps 23 off the carding 28 with attendant at least partial disintegration of the clumps. The shreds of the broken up clumps 23 are entrained by the carding 28 or descend onto the second conveyor 21 to pass through the openings 20 and onto the conveyor 8 or to be again entrained by the carding 28 and transported toward, past and beyond the combing roller 31. The procedure can be repeated more than once until the clumps 23 are broken up into discrete shreds or into smaller accumulations of shreds which can bypass the prongs 32 of the combing roller 31.

The combing roller 31 and its prongs 32 perform a desirable metering action in that they limit the quantity of shreds which can be entrained by the carding 28 past the roller 31 for delivery into the magazine 37. In other words, the combing roller 31 determines the percentage of long shreds 22 and of the shreds of the broken up clumps 23 in the homogeneous mass 38 which accumulates in the magazine 37.

At least the majority of long shreds 22 normally bypass the combing roller 31 and advance into the range of pins 34 on a rapidly rotating picker roller 33 which expels the shreds 22 and the shreds of the partially or completely disintegrated clumps 23 into a chute 36 for delivery into the duct 37. The pins 34 of the picker roller 33 normally break up any remnants of the clumps 23 so that the material which descends in the chute 36 consists of non-interlaced shreds including a high percentage of long shreds 22. At any rate, the interlacing of shreds in the chute 36 is minimal in comparison with that of the shreds which form the clumps 23. The mass or column 38 of shreds 5, 22 and of the shreds of broken up clumps 23 in the duct 37 is homogeneous and rather loose so that it can be converted into a highly satisfactory tobacco stream preparatory to trimming, compacting and draping into a web of cigarette paper or other suitable wrapping material. It has been found that the percentage of fragments 24 of ribs in the column 38 is nil or negligible. The same holds true for the percentage of clumps in comparison with those in the smokable material 4 which is being fed onto the sieve 6.

The apparatus preferably further comprises a driven magnetic roller 39 a portion of which extends into the duct 37 at a level below the chute 36 and the discharge end of the conveyor 8 so that it can attract any ferromagnetic metallic particles which might be present in the material that is to form the column 38. The roller 39 delivers the metallic particles (if any) into a collecting box 41.

The manner in which the column 38 in the duct 37 can be converted into a continuous tobacco stream is disclosed, for example, in commonly owned U.S. Pat. No. 4,185,644 granted Jan. 29, 1980 to Uwe Heitmann et al.

It is also within the purview of the invention to separate the short and medium long shreds 5 from the long shreds 22 and clumps 23 downstream of the orienting station (conveyor 21) for the fragments 24 of ribs or the like. However, the illustrated apparatus (wherein the sieve 6 is located upstream of the conveyor 21) is preferred at this time because the short and medium long shreds 5 could interfere with proper orientation and hence with effective segregation of fragments 21 from the long shreds 22 and clumps 23.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of forming a homogeneous mass from an agglomeration of tobacco and/or other smokable material including short, medium long and long shreds as well as lumps of shreds and elongated relatively rigid constituents, such as portions of tobacco ribs, comprising the steps of sifting the agglomeration to thereby separate short and medium long shreds from long shreds, lumps and rigid constituents; imparting to the rigid constituents a predetermined orientation; segregating the long shreds and the lumps from the thus oriented rigid constituents; and merging the thus segregated long shreds and the shreds of the lumps with the short and medium long shreds.

2. The method of claim 1, wherein said sifting step includes vibrating the agglomeration.

3. The method of claim 1, wherein said orientation imparting step includes vibrating the rigid constituents.

4. The method of claim 1, wherein said segregating step includes transporting the long shreds, the lumps and the rigid constituents along a first path and diverting the long shreds and the lumps from said first into a different second path.

5. The method of claim 1, wherein said orientation imparting step includes transferring the rigid constituents onto the undulate surface of a vibrating conveyor so that the rigid constituents find their way into the valleys of the undulate surface.

6. The method of claim 1, wherein said orientation imparting step includes transferring the rigid constituents onto the surface of a vibrating conveyor whose surface has elongated parallel grooves of substantially triangular cross-sectional outline so that the rigid constituents come to rest in the bottom regions and extend longitudinally of such grooves.

7. The method of claim 1, wherein said sifting step precedes said orientation imparting step.

8. The method of claim 1, wherein said merging step includes admitting metered quantities of long shreds and of the shreds of said lumps to the short and medium long shreds.

9. The method of claim 1, further comprising the step of breaking up the lumps not later than in the course of said merging step.

10. The method of claim 9, wherein said breaking up step takes place subsequent to said segregating step but prior to said merging step.

11. Apparatus for forming a homogeneous mass from an agglomeration of tobacco and/or other smokable material including short, medium long and long shreds as well as lumps of shreds and elongated relatively rigid constituents, such as portions of tobacco ribs, comprising a sifting device of a mesh such as to permit the passage of short and medium long shreds; means for vibrating said sifting device; means for feeding the agglomeration of shreds and rigid constituents so that the sifting device separates the short and medium long shreds from the long shreds, lumps and rigid constituents; first conveyor means for transporting the separated short and medium long shreds along a first path; second conveyor means for transporting the separated long shreds, lumps and rigid constituents along a second path; means for imparting to the rigid constituents a predetermined orientation; and means for segregating the long shreds and the lumps from the oriented rigid constituents.

12. The apparatus of claim 11, further comprising third conveyor means for transporting the segregated long shreds and the shreds of said lumps into said first path so that such shreds merge into the previously separated short and medium long shreds.

13. The apparatus of claim 12, wherein said third conveyor means includes means for admitting metered quantities of long shreds and of the shreds of said lumps into said first path.

14. The apparatus of claim 11, wherein said second conveyor means is arranged to advance the long shreds, the lumps and the rigid constituents in a predetermined direction and said orientation imparting means includes a vibratory conveyor having elongated recesses extending in said direction and arranged to receive the elongated rigid constituents so that such constituents extend longitudinally of the respective recesses.

15. The apparatus of claim 14, wherein said vibratory conveyor has an undulate upper surface provided with alternating hills and valleys and said valleys constitute said recesses.

16. The apparatus of claim 14, wherein said recesses have a substantially triangular cross-sectional outline.

17. The apparatus of claim 14, wherein said orientation imparting means is part of or constitutes said second conveyor means.

18. The apparatus of claim 14, wherein said sifting device is arranged to advance the long shreds, the lumps and the rigid constituents in said predetermined direction and said second conveyor means is immediately adjacent to and receives the long shreds, the lumps and the rigid constituents directly from said sifting device.

19. The apparatus of claim 11, wherein said orientation imparting means has openings for gravitational descent of short and medium long shreds which might have been entrained into said second path.

20. The apparatus of claim 11, further comprising third conveyor means for transporting the segregated long shreds and the shreds of said lumps into said first path and means for breaking up at least some of the lumps ahead of said first path.

21. The apparatus of claim 11, further comprising a magazine for reception of short and medium long shreds from said first path and third conveyor means for transporting the segregated long shreds and the shreds of said lumps into said magazine.

22. The apparatus of claim 11, wherein said vibrating means includes means for vibrating said first conveyor means jointly with said sifting device.

23. The apparatus of claim 11, further comprising means for regulating said feeding means so that said sifting device receives predetermined quantities of said agglomeration per unit of time.

24. The apparatus of claim 11, wherein said second conveyor means comprises a vibratory conveyor disposed at a level below said sifting device.

25. The apparatus of claim 24, wherein said vibrating means includes a common vibrator for said sifting device and said vibratory conveyor.

* * * * *